United States Patent [19]

Foster et al.

[11] Patent Number: 4,813,209

[45] Date of Patent: Mar. 21, 1989

[54] SINGLE CYCLE ENVELOPE FLAP OPENER

[75] Inventors: Dean H. Foster, Stratford; Karel Janatka, Southbury, both of Conn.

[73] Assignee: Pitney Bowes Inc., Stamford, Conn.

[21] Appl. No.: 186,981

[22] Filed: Apr. 29, 1988

[51] Int. Cl.[4] ..... B65B 43/26; B65B 43/39

[52] U.S. Cl. ..... 53/381 R; 53/266 A

[58] Field of Search ..... 53/569, 266 A, 381 R, 53/382, 460, 492; 493/409

[56] References Cited

U.S. PATENT DOCUMENTS

| | | | |
|---|---|---|---|
| 2,668,053 | 2/1954 | Bach | 53/381 R |
| 2,766,569 | 10/1956 | Strother | 53/266 A |
| 3,162,435 | 12/1964 | Rastorguyeff et al. | 493/409 |
| 4,295,321 | 10/1981 | De Hart | 53/381 R |
| 4,715,164 | 12/1987 | Luperti et al. | 53/381 R |

*Primary Examiner*—John Sipos

*Attorney, Agent, or Firm*—Lawrence E. Sklar; David E. Pitchenik; Melvin J. Scolnick

[57] ABSTRACT

Apparatus is provided for opening the flap of a document having a bent-over flap. The apparatus includes a pair of side frames, a driven, transfer roller rotatably mounted in said frames, a first, rotatably mounted pressure roller disposed against said transfer roller and providing between itself and said transfer roller a first nip for receiving said document, and a second, rotatably mounted pressure roller disposed against said transfer roller, said second roller being spaced from said first roller about the periphery of said transfer roller and providing between itself and said transfer roller a second nip for receiving said document. The apparatus further includes an upper, arcuate guide pivotably mounted to said frames for receiving the document from said first nip and guiding said document toward said second nip, said upper guide pivotable between a first position adjacent said transfer roller and a second position remote from said transfer roller, and a lower, arcuate guide pivotably mounted to said frames and hingedly connected to said upper guide. The lower guide has a flap-engaging lip oriented to engage and bend back the flap of said document as said document traverses said lower guide. The lower guide is pivotable between a first, non-flap-engaging position and a second, flap-opening position, said lower guide being pivotable to said flap-opening position by the document as it traverses said lower guide. The pivoting of said lower guide causes said upper guide to pivot to said second position remote from said transfer roller, thereby allowing said document with said flap to pass through the gap between said transfer roller and said upper guide.

6 Claims, 4 Drawing Sheets

SINGLE CYCLE ENVELOPE FLAP OPENER

BACKGROUND OF THE INVENTION

The invention relates to an improved apparatus for conditioning an article, such as an envelope, having a bentover flap. More particularly, the invention relates to an improved apparatus for opening envelopes at rates compatible with high speed serial feeding of opened envelopes to a work station.

In conventional high volume mailrooms utilizing document inserting apparatus, envelopes are delivered to a work station in opened condition and arranged so that sheets or documents may be inserted into the envelope. Thus, the envelopes, which are typically furnished by the manufacturer with the flap folded firmly against the body, must be serially opened individually and then serially fed to the work station with the flap bent back so as to permit access to the interior of the envelope. Conventional envelope-opening devices have worked well in relatively slow mailing systems, but in order to continue to meet mailing deadlines as the volume of mail increases it has become necessary to substantially increase the throughput of the envelope conditioning apparatus.

U.S. Pat. No. 2,668,053 issued to Bach discloses a two-cycle envelope-opening device in which an envelope is fed edgewise in a first direction, flap edge foremost, along a curved path into abutment against a stop positioned such that the flap passes beyond a stripper plate and then in a second, oppositely-directed movement is fed past the stripper plate which then engages the flap and folds it back as the envelope moves by. This device works well at slower speeds but because of the paper paths which must be sequentially negotiated by the envelopes, any jams which occur normally involve at least two envelopes so that they are difficult to clear and, since the envelope must come to a complete stop and then reverse direction during the cycle, the possibilities for increased speed are limited. A further nuisance in such prior devices is that two cycles must occur before proper insertion of documents into an envelope is re-established.

U.S. Pat. No. 3,162,435 issued to Rastorguyeff, et al. addressed and solved some of the problems mentioned above by utilizing a different technique for opening envelope flaps. In this device a flap-intercepting nose of a pivoted member is driven toward the envelope body by the force of the lower edge of the envelope striking a lever arm of the member as the enveloped is transported around a transfer roller. The feeding movement of the envelope against the lever arm causes this nose to slideably engage and fold back the flap. While this device has also worked well at low speeds, it cannot be easily adjusted to accommodate the various thicknesses and stiffnesses of the envelopes available. An even more significant limitation has been found in that in high speed operation using such devices, instances have occurred where the flaps of envelopes have been completely sheared off, apparently because of the increased engaged force of the intercepting edge created by particular combinations of envelope thickness and speed.

A solution to the problems described above is found in U.S. Pat. No. 4,715,164 assigned to the assignee of the instant application, where a high-speed flap-opening device is used in combination with a relatively large transfer roller having two spaced rollers disposed along the periphery thereof to form two separated nips. The pivotable envelope flap-opener includes a guide having a lip for engaging the flap of the envelope and is disposed in a first position for receiving an envelope from the first nip. The force of the envelope causes the flap-opener to pivot to a second position which guides the envelope to the second nip. As the flap emerges from the first nip, the lip of the flap-opener engages the flap to bend it back as the envelope passes through the second nip.

Experience with the flap-opener of the '164 patent has shown that the flap-opener is subjected to considerable forces and inertia resulting from constant pivoting, and that owing to the considerable mass of the flap-opener, that long-term viability of the device is not optimal. The instant invention provides a flap-opening device which utilizes a pair of guides disposed adjacent the periphery of a transfer roller which are subjected to less force than the flap-opener of the '164 patent and hence a longer life span of the device is achieved.

SUMMARY OF THE INVENTION

Accordingly, the instant invention provides apparatus for opening the flap of a document having a bent-over flap. The apparatus includes a pair of side frames, a driven, transfer roller rotatably mounted in said frames, a first, rotatably mounted pressure roller disposed against said transfer roller and providing between itself and said transfer roller a first nip for receiving said document, and a second, rotatably mounted pressure roller disposed against said transfer roller, said second roller being spaced from said first roller about the periphery of said transfer roller and providing between itself and said transfer roller a second nip for receiving said document. The apparatus further includes an upper, arcuate guide pivotably mounted to said frames for receiving the document from said first nip and guiding said document toward said second nip, said upper guide pivotable between a first position adjacent said transfer roller and a second position remote from said transfer roller, and a lower, arcuate guide pivotably mounted to said frames and hingedly connected to said upper guide. The lower guide has a flap-engaging lip oriented to engage and bend back the flap of said document as said document traverses said lower guide. The lower guide is pivotable between a first, non-flap-engaging position and a second, flap-opening position, said lower guide being pivotable to said flap-opening position by the document as it traverses said lower guide. The pivoting of said lower guide causes said upper guide to pivot to said second position remote from said transfer roller, thereby allowing said document with said flap to pass through the gap between said transfer roller and said upper guide.

DESCRIPTION OF THE PREFERRED EMBODIMENT

Figure 1:
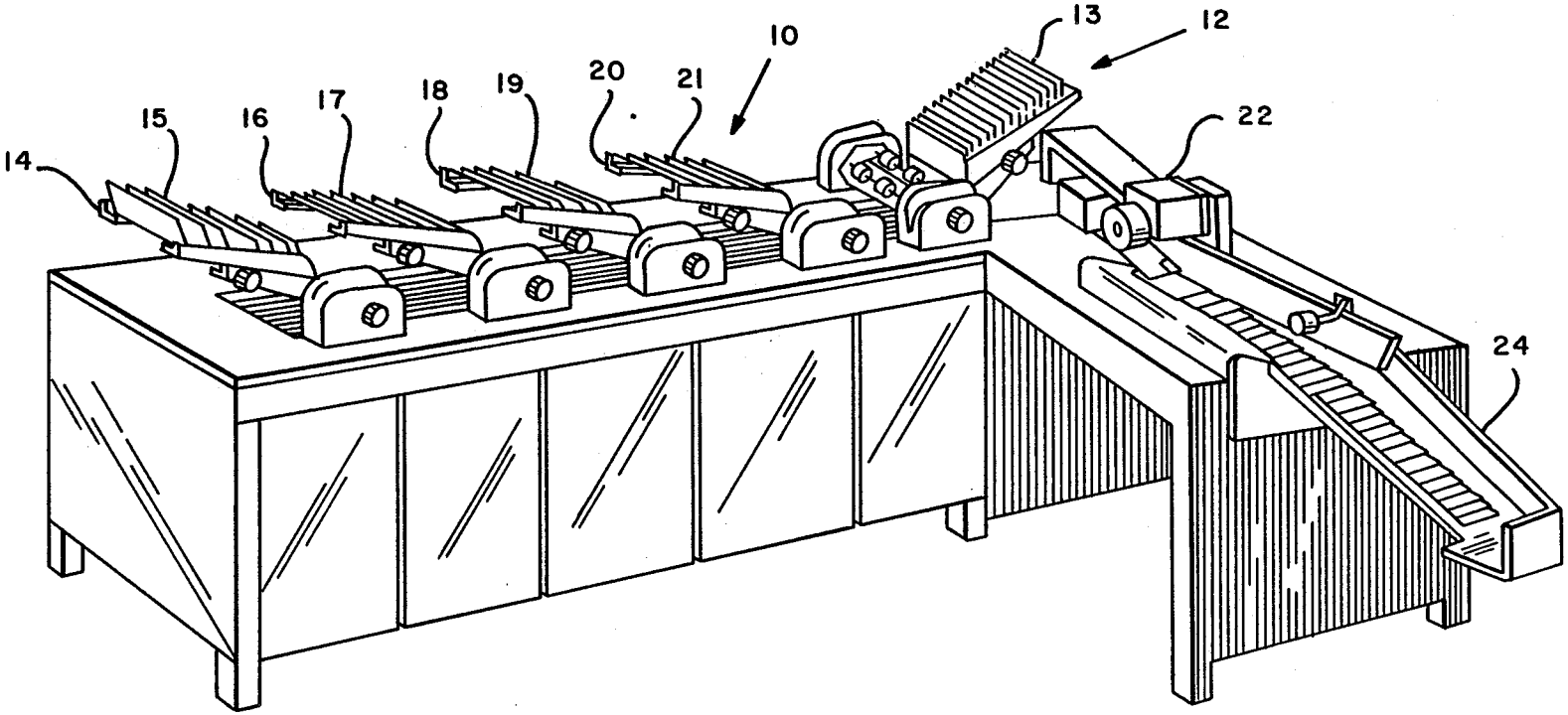
FIG. 1 is a perspective view of a complete mailing system in which an envelope opening apparatus having an improved flap opening device in accordance with the instant invention may be utilized.

In describing the preferred embodiment of the instant invention, reference is made to the drawings wherein there is seen in FIG. 1 a typically configured mailing system generally designated 10. Such a system is described in U.S. Pat. No. 3,935,429 issued to Branecky et al. and assigned to the assignee of the instant invention. An envelope feeder apparatus 12 in which the improved flap opening device in accordance with the invention may be utilized opens the envelopes 13 and positions them serially in an inserter stop where the documents 15, 17, 19 and 21 fed respectively from document feeders 14, 16, 18 and 20 are inserted into an envelope 13. The filled envelope 13 is then transported from the envelope feeder 12 to a postage meter 22 where the postage is applied and then to a power stacker 24. It will be appreciated that other configurations of mailing systems are well known and that the envelope feeder 12 incorporating the instant invention may be utilized in configurations other than the one illustrated.

Figure 3:
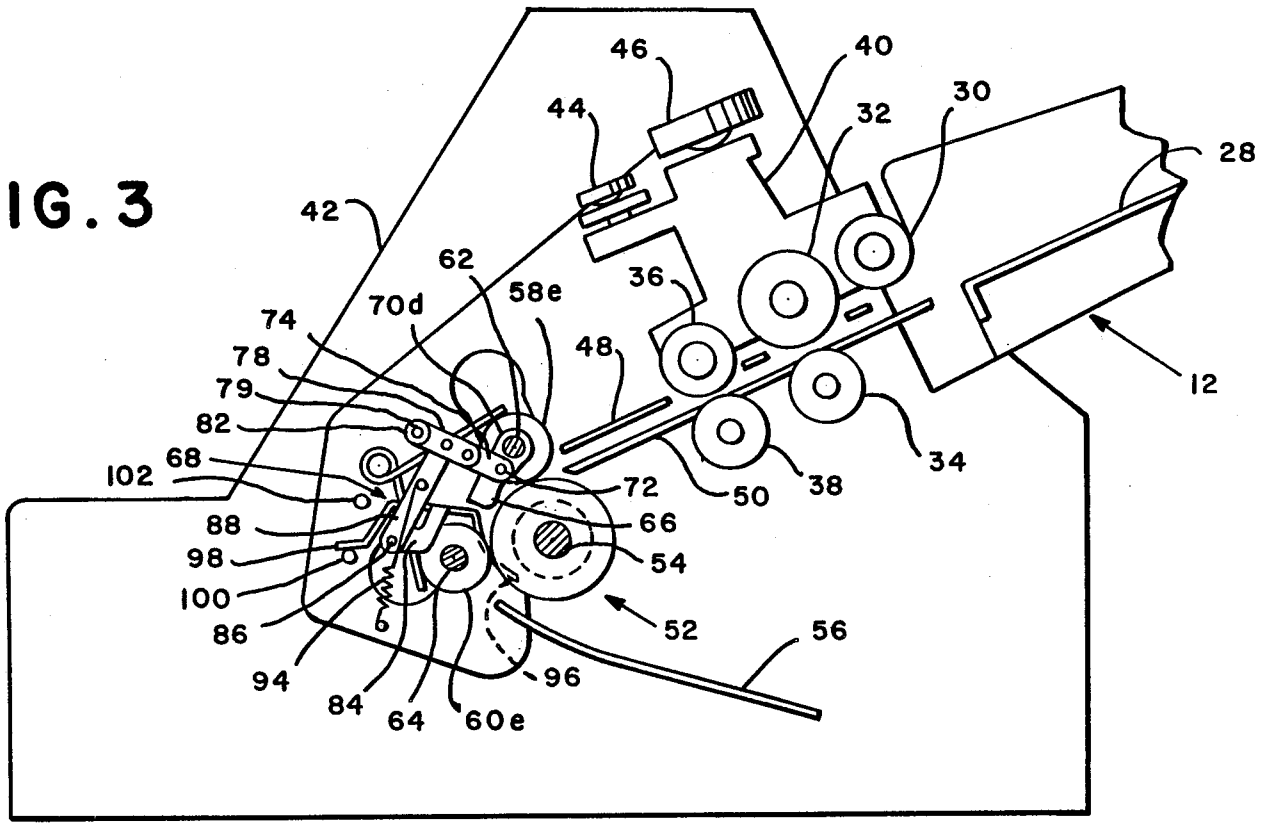
FIG. 3 is a schematic, side elevational view of the envelope opening device illustrating the relationship of the improved flap opening elements to the other parts of the device.

Considering now FIG. 3, there is shown in simplified, schematic form an embodiment of the flap-opening device which may be utilized in the envelope feeder 12. A feed roller 30 is disposed in conventional manner in the envelope feeder 12 for engaging and feeding envelopes 13 stacked on the deck 28 to the gap between separator roller 32 and separator stone 34. Downstream of the separator roller 32 and stone 34 are located the demand roller pair 36 and 38. The rollers 30, 32 and 36 are all mounted on block 40 which is suitably adjusted with respect to a frame 42 and thus with respect to the stone 34 and roller 38 by knurled nuts 44 and 46 shown schematically in FIG. 3. The rollers 30, 32, 36 and 38 are driven in timed sequence in conventional manner, as, for example, described in the aforementioned U.S. Pat. No. 3,935,429, in order to feed envelopes serially through guides 48 and 50 toward the main or transfer roller 52.

Figure 2:
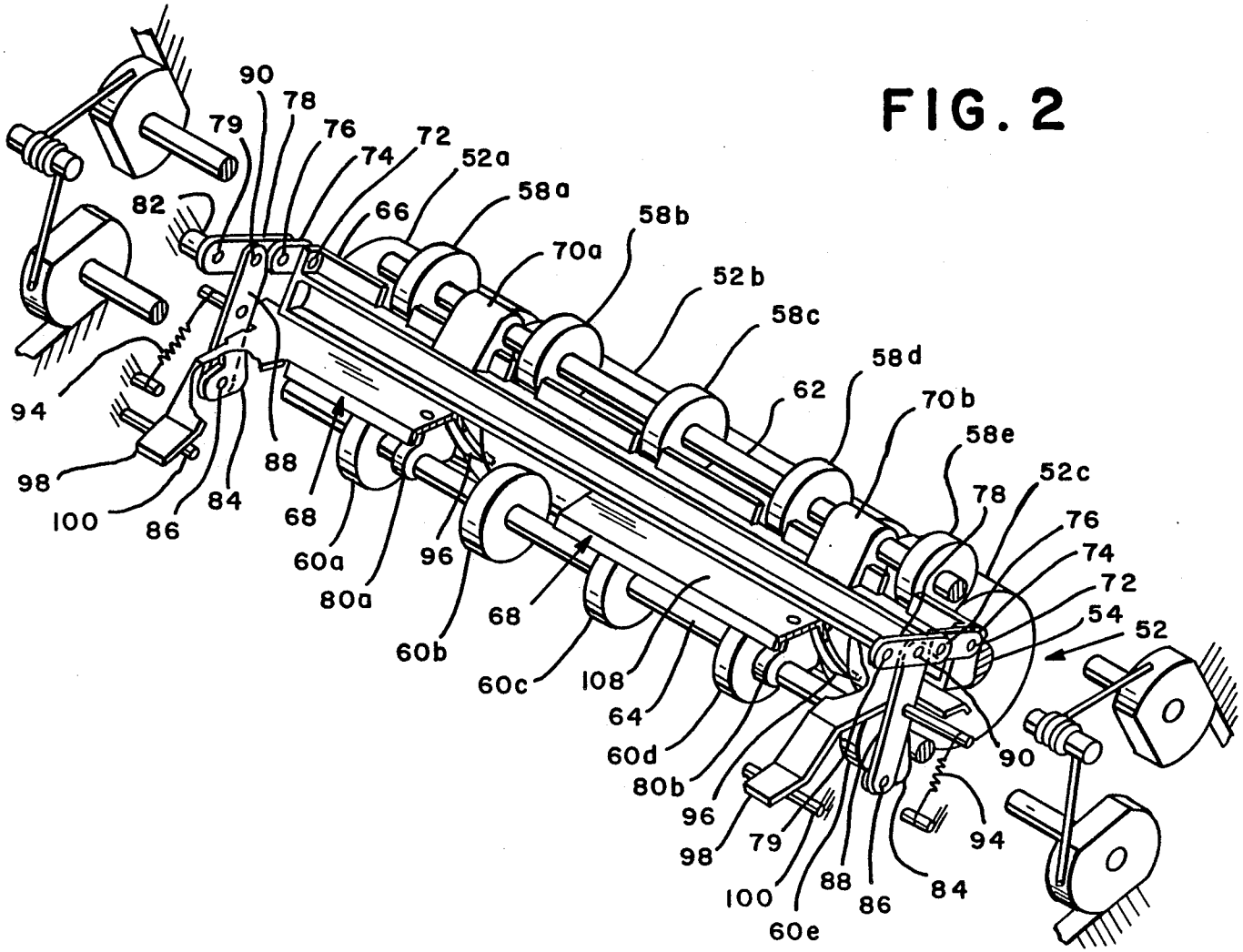
FIG. 2 is a perspective view of the operative portion of the envelope flap opening device with the remainder of the device not shown for ease of illustration.

The transfer roller 52 may be a continuous roller but in FIG. 2 is shown as consisting of three segments 52*a*, 52*b* and 52*c* spaced on roller shaft 54 which is rotatably driven in conjunction with the feeding of an envelope 13 through the demand rollers 36 and 38 to the guides 48 and 50 and around the periphery of the transfer roller 52 onto a ledge 56.

A plurality of pressure rollers 58*a* through 58*e* and 60*a* through 60*e* are spaced apart along shafts 62 and 64 respectively. Each set of pressure rollers 58*a–e* and 60*a–e* thus positioned form first and second nips respectively between themselves and the transfer roller 52.

The flap-opening device of the instant invention comprises, in addition to the rollers 52, 58 and 60, an upper, arcuate guide 66 and a lower, arcuate guide 68 hingedly connected to the upper guide 66. The upper guide 66 is rotatably mounted on the shaft 62 by means of bushings 70*a* and 70*b* and is pivotably connected by a pair of pins 72 to a pair of first linkage arms 74 which in turn are pivotably connected by a pair of pins 76 to a second pair of linkage arms 78. The arms 78 are pivotably connected by means of pins 79 to stationary supporting posts 82.

The lower guide 68 is rotatably mounted on the shaft 64 by means of bushings 80*a* and 80*b* and is pivotably connected through the flanges 84 of the lower guide 68 (see FIG. 2) by a pair of pins 86 to a third pair of linkage arms 88. The second pair of linkage arms 78 are pivotably connected to the third pair of linkage arms 88 by a pair of pins 90. The various pairs of linkage arms combine to form a locking linkage, whose operation is discussed hereinbelow.

Figure 4:
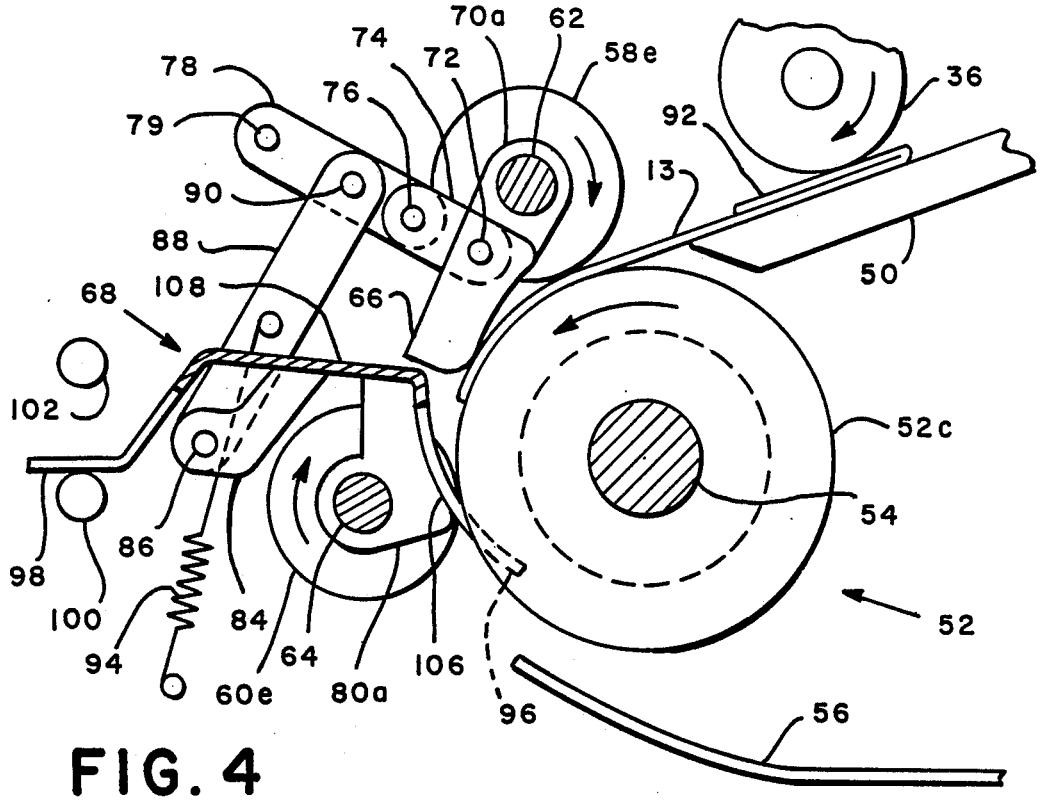
FIG. 4 is a central, vertical, sectional view of the flap opening device showing the envelope entering with its flap folded firmly against the envelope body.
Figure 5:
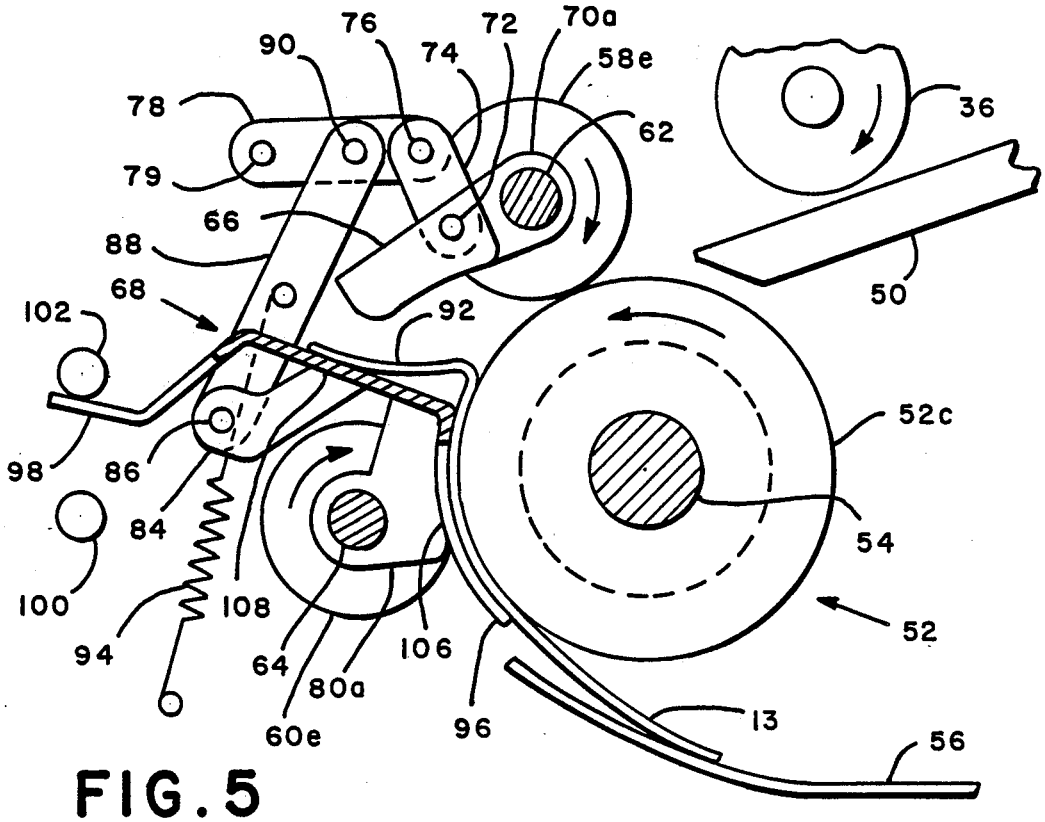
FIG. 5 is the same as FIG. 4 except the flap of the envelope has been bent back.

In operation, an envelope 13 having a flap 92 is fed by rollers 36 and 38 to the nip of rollers 52 and 58 and thence around the roller 52 by virtue of the upper guide 66 which, when in its first position adjacent the transfer roller 52, as seen in FIG. 4, forces the envelope 13 to follow the contour of the roller 52. The guide 66 is biased toward the transfer roller 52 by a pair of springs 94 which are secured to the third pair of linkage arms 88. It is critical to the successful operation of the flap opening device that the upper guide not be pivotable away from the transfer roller 52 when struck by an envelope 13 traversing the periphery of the transfer roller 52; the locking linkage described hereinabove prevents the pivoting of the guide 66 when struck by an envelope 13. As the envelope 13 continues to traverse the periphery of the transfer roller 52 it strikes the lower guide 68, which as seen in FIG. 4, includes a pair of extending fingers 96 which extend into the interior of the roller 52 in the gap between segments 52*a* and 52*b* and the gap between segments 52*b* and 52*c*. The envelope 13 striking the lower guide 68 causes the guide 68 to pivot away from the transfer roller 52 to the position seen in FIG. 5. The force of the envelope 13 striking the lower guide 68 is such to overcome the tension in the biasing spring 94. The spring tension is adjusted to hold the flange portions 98 of the guide 68 against the lower stops 100 but also to allow the flange portions 98 to be pivoted upward by the force of an envelope 13 against the upper stops 102. When the lower guide 68 is pivoted to the position seen in FIG. 5, the arcuate portion 106 of the guide 68 is spaced from the roller 52 by a pre-set distance, thereby defining a pre-set gap for the envelope 13 to traverse. The straight lip portion 108 of the guide 68 engages the flap 92 of the envelope 13 by virtue of being positioned virtually parallel to a radius of the roller 52 extending toward the straight, flap-engaging portion 108 of the guide 68. By being positioned virtually adjacent the roller 52, the lip 108 of the guide 68 intercepts the flap 92 of the envelope 13 and causes it to become separated and bent back and away from the body of the envelope 13 as the envelope 13 traverses the gap between the roller 52 and the arcuate portion 106 of the guide 68. The envelope 13 emerges from the gap between the roller 52 and the guide 68 with its flap 92 bent back as it is deposited on the ledge 56 from whence it will be transported to a position at which the documents 15, 17, 19 and/or 21 will be inserted into the envelope 13.

It should be understood by those skilled in the art that various modifications may be made in the present invention without departing from the spirit and scope thereof, as described in the specification and defined in the appended claims.

What is claimed is:

1. Apparatus for opening the flap of a document having a bent-over flap, comprising:

a pair of side frames;

a driven, transfer roller rotatably mounted in said frames;

a first, rotatably mounted pressure roller disposed against said transfer roller and providing between itself and said transfer roller a first nip for receiving said document;

a second, rotatably mounted pressure roller disposed against said transfer roller, said second roller being spaced from said first roller about the periphery of said transfer roller and providing between itself and said transfer roller a second nip for receiving said document;

an upper, arcuate guide pivotably mounted to said frames for receiving the document from said first nip and guiding said document toward said second nip, said upper guide pivotable between a first position adjacent said transfer roller and a second position remote from said transfer roller;

a lower, arcuate guide pivotably mounted to said frames and hingedly connected to said upper guide, said lower guide having a flap-engaging lip oriented to engage and bend back the flap of said document as said document traverses said lower guide, said lower guide pivotable between a first, non-flap-engaging position and a second, flap-opening position, said lower guide being pivotable to said flap-engaging position by the document as it traverses said lower guide, and wherein the pivoting of said lower guide causes said upper guide to pivot to said second position remote from said transfer roller, thereby allowing said document with said flap to pass through the gap between said transfer roller and said upper guide.

2. The apparatus of claim 1, wherein said transfer roller consists of a plurality of segments.

3. The apparatus of claim 2, wherein said first and second pressure rollers consist of a plurality of segments.

4. The apparatus of claim 1 additionally comprising locking linkage connecting said upper and lower guides, said locking linkage causing said upper guide to pivot to said second position only when said lower guide is pivoted to said flap-engaging position.

5. The apparatus of claim 4, wherein said transfer roller consists of a plurality of segments.

6. The apparatus of claim 5, wherein said first and second pressure rollers consist of a plurality of segments.

* * * * *